US011087907B2

(12) United States Patent
Löwe et al.

(10) Patent No.: US 11,087,907 B2
(45) Date of Patent: Aug. 10, 2021

(54) ARTIFICIAL PERMANENT MAGNET AND METHOD FOR PRODUCING THE ARTIFICIAL PERMANENT MAGNET

(71) Applicant: TECHNISCHE UNIVERSITÄT DARMSTADT, Darmstadt (DE)

(72) Inventors: Konrad Löwe, Darmstadt (DE); Wilhelm Fernengel, Kleinostheim (DE); Konstantin Skokov, Darmstadt (DE); Oliver Gutfleisch, Darmstadt (DE)

(73) Assignee: TECHNISCHE UNIVERSITÄT DARMSTADT, Darmstadt (DE)

( * ) Notice: Subject to any disclaimer, the term of this patent is extended or adjusted under 35 U.S.C. 154(b) by 594 days.

(21) Appl. No.: 15/572,060

(22) PCT Filed: May 12, 2016

(86) PCT No.: PCT/EP2016/060633
§ 371 (c)(1),
(2) Date: Mar. 26, 2018

(87) PCT Pub. No.: WO2016/180912
PCT Pub. Date: Nov. 17, 2016

(65) Prior Publication Data

US 2018/0211749 A1 Jul. 26, 2018

(30) Foreign Application Priority Data

May 12, 2015 (DE) ..... 10 2015 107 486.9

(51) Int. Cl.
*H01F 1/057* (2006.01)
*H01F 41/02* (2006.01)
*B22F 1/00* (2006.01)

(52) U.S. Cl.
CPC ..... *H01F 1/0577* (2013.01); *H01F 41/0273* (2013.01); *B22F 1/0011* (2013.01); *B22F 2301/355* (2013.01); *B22F 2304/10* (2013.01)

(58) Field of Classification Search
None
See application file for complete search history.

(56) References Cited

U.S. PATENT DOCUMENTS

2011/0233455 A1* 9/2011 Yan ..... H01F 1/0577 252/62.55
2015/0243415 A1* 8/2015 Sun ..... C22C 38/002 148/103
2016/0307676 A1* 10/2016 Deng ..... H01F 1/0577

FOREIGN PATENT DOCUMENTS

DE 102014103210 A1 10/2014
EP 1523017 A2 4/2005
EP 1860668 A1 11/2007

OTHER PUBLICATIONS

International Search Report (dated Aug. 2, 2018) for corresponding International App. PCT/EP2016/060633.

* cited by examiner

*Primary Examiner* — Xiaowei Su
(74) *Attorney, Agent, or Firm* — WRB-IP LLP

(57) ABSTRACT

A method is provided for producing an artificial permanent magnet, in a powder preparation step a main phase powder, which includes a rare-earth transition metal compound with permanently magnetic properties and has a first average particle size, is prepared and an anisotropic powder, which has a higher anisotropy field strength than the main phase powder and has a second average particle size, is prepared, wherein the second average particle size is smaller than the first average particle size. In a subsequent powder mixing step, the main phase powder and the anisotropic powder are (Continued)

mixed together to form a powder mixture and, in a subsequent heat treatment step, this powder mixture with the main phase powder of the first average particle size and with the anisotropic powder of the second average particle size is sintered to form an artificial permanent magnet.

8 Claims, 1 Drawing Sheet

ARTIFICIAL PERMANENT MAGNET AND METHOD FOR PRODUCING THE ARTIFICIAL PERMANENT MAGNET

BACKGROUND AND SUMMARY

The invention relates to a method for producing an artificial permanent magnet.

From a hard-magnetic material such as iron, cobalt or nickel, for example, or also from rare-earth alloys, artificial permanent magnets can be produced, which generate a permanent, substantially static magnetic field in the surroundings of the permanent magnet. Permanent magnets are used in numerous application fields, and thus there is a high demand for different permanent magnets. Numerous methods have been developed, by means of which artificial permanent magnets can be produced from suitable permanent magnet materials and magnetized. Depending on the respective production methods used and the respective permanent magnet materials, permanent magnets with different properties and adapted to the respective purpose of use can be produced.

A production method proved in practice uses a crystalline powder made of a suitable permanent magnet material or of a combination of several permanent magnet materials. Moreover, additives or binders can be admixed. The crystalline powder is pressed to form a pellet and this pellet is then sintered, wherein, during the sintering process, the compressed powder grains can be connected to one another and solidified by heating usually to temperatures above 1000° C.

The permanently magnetic properties of an artificial permanent magnet thus produced are influenced and specified largely by various characteristic properties such as, for example, saturation magnetization, anisotropy field strength or Curie temperature and, in particular, coercive field strength and remanence. For numerous application cases, it is advantageous here if the permanent magnet has both a high coercive field strength and also a high remanence, so that, during the production method or thereafter, the artificial permanent magnet magnetized by means of an external magnetic field preserves its magnetization outside of the external magnetic field for as long as possible and also for as long as possible following exposure to a demagnetizing magnetic field.

It has been shown that, from alloys containing both iron metals and also rare-earth metals, artificial permanent magnets having advantageous properties, in particular a high remanence and a high coercive field strength, can be produced. Frequently used and cost-effective alloys from which rare-earth magnets can be produced are neodymium-iron-boron or samarium-cobalt, for example.

In addition to a suitable selection of hard magnetic materials and alloys, the magnetic properties can be reinforced or improved in that a powder produced therefrom is exposed to a strong external magnetic field during the pressing to form a pellet, so that the individual particles of the powder align with a preferred magnetization axis in the direction of the external magnetic field.

In order to further improve the magnetic properties of such rare-earth magnets, various methods have been developed, by means of which, via the introduction of suitable chemical elements, components or substances into the sintered permanent magnets, individual magnetic properties can be improved or reinforced in a targeted manner. For example, it has been shown that, in rare-earth magnets, the coercive field strengths of the sintered permanent magnets can be increased by substitution of individual chemical elements such as, for example, light-weight rare-earth elements with added elements such as, for example, heavy rare-earth elements, or by substitution of iron with other chemical elements such as, for example, aluminum, gallium, copper, tin, etc. For this reason, it is known from practice to admix a suitable proportion of added elements already at the time of the melting of the alloys to be used for producing the powder and for the subsequent sintering process, said added elements being largely homogeneously distributed during the sintering process or during the heating of the pellet in the permanent magnet produced thereby. The added elements penetrate into the permanently magnetic particles, which are not molten during the sintering process, by diffusion and influence the magnetic properties of the individual permanently magnetic particles and thus of the entire sintered permanent magnet.

Investigations have shown that the permanently magnetic properties can be improved by increasing the anisotropy field strength of the permanently magnetic particles. By introducing suitable added elements, the anisotropy field strengths can be increased and the magnetic interactions between individual adjacent particles can be reduced at the same time. However, all, the chemical elements examined to date, which have been admixed as added elements for increasing the anisotropy field strength in the powder and which are substantially homogeneously distributed in the individual particles during the sintering process, bring about a reduction of the remanence. The anisotropy field strength is influenced largely by the added elements introduced in an edge region of a permanently magnetic particle, while in a core region of the particles the same added elements have a barely measurable effect or no measurable effect on the anisotropy field strength. In contrast, by the introduction of added elements both in the edge region and also in the core region of a particle, the remanence of a particle is lowered.

By admixing added elements in the powder, from which the pellet is pressed and subsequently the permanent magnet is sintered, it is only possible in most cases to generate a substantially homogeneous distribution of the added elements within the permanent magnet and, in particular, within the individual permanently magnetic particles. The desired advantage for the permanently magnetic properties of the permanent magnet, which is achieved with a reinforced addition of added elements by the reinforced anisotropy field strength in the edge area of the particles, can be offset by the reduction of the remanence brought about in the entire particle, so that overall the reinforced addition of added elements may even turn out to be disadvantageous.

It has been shown that grain boundary diffusion can be used advantageously for producing artificial permanent magnets. If an already sintered permanent magnet is subsequently heated again and brought in contact with a suitable added element, the added element diffuses more strongly along the grain boundaries between the individual permanently magnetic particles into the sintered permanent magnet and consequently its concentration is increased in the edge regions of the individual particles. In this way, the anisotropy field strength can be increased, without entailing a clear lowering of the associated remanence of the permanent magnet. However, it has been shown that the added elements which are suitable for improving the magnetic properties can only be introduced into a small edge region of approximately 2 to 3 mm of the permanent magnet by means of grain boundary diffusion. Accordingly, using the method of grain boundary diffusion, a small artificial permanent magnet having dimensions in the range of a few millimeters can be clearly improved, while the magnetic properties of a larger artificial permanent magnet with a diameter of more than 5 to 10 mm, for example, can only be influenced minimally, and the grain size diffusion method often cannot be used economically in practice.

Therefore, it is desirable to provide a method for producing an artificial permanent magnet, in such a manner that the magnetic properties of a sintered permanent magnet can be influenced or improved.

According to an aspect of the invention, a method is provided wherein, in a powder preparation step, a main phase powder, which comprises a rare-earth transition metal compound with permanently magnetic properties and with a first average particle size, is prepared, and an anisotropic powder, which has a higher anisotropy field strength than the main phase powder and has a second average particle size which is smaller than the first average particle size, is prepared, wherein in a powder mixing step, the main phase powder and the anisotropic powder are mixed together to form a powder mixture, wherein subsequently, using conventional powder metallurgic methods, a dense molded body is generated, and wherein in a subsequent heat treatment step, the powder mixture with the main phase powder of the first average particle size and with the anisotropic powder of the second average particle size is sintered to form an artificial permanent magnet. The method according to the invention makes use of the fact that during the heating small particles melt more rapidly than large particles or melt completely in the course of the sintering. By the specification of the different average particle sizes according to the invention, it is achieved that the anisotropic powder of the smaller particle size added to the powder mixture starts melting or melts more rapidly during the sintering process, and the particles of the main phase powder having the larger average particle size largely preserve their fixed shape. The added elements contained in the anisotropic powder become rapidly mobile due to the early start of the melting of the smaller particles and they penetrate into edge regions of the considerably larger particles of the main phase powder. By a suitable specification of the sintering temperature and of the duration of the sintering process, it is possible to achieve that an advantageous increase in the concentration of the added elements originating from the anisotropic powder can be reached in the edge region of the particles of the main phase powder, while a core region of the larger particles of the main phase powder remains largely free of added elements.

Advantageously, it is provided that, during the sintering process, the small particles of the anisotropic powder melt substantially completely, and the chemical composition of a liquid phase generated during the sintering process from the anisotropic powder is established and specified largely by the chemical composition of the anisotropic powder. In a subsequent cooling process, the liquid phase crystallizes on the edge regions of the particles of the main phase powder. Due to grain boundary diffusion, the liquid phase is distributed rapidly and surrounds the particles of the main phase powder, so that the chemical elements can penetrate rapidly from the liquid phase into the edge region of the particles of the main phase powder.

Both the main phase powder and the anisotropic powder usually comprise particles having a particle size distribution which extends over a size range. As average particle size, a suitable statistical parameter for an average value of the frequency distribution of the particle size present in an individual case, such as, for example, a median or an arithmetic mean of the particle size distribution, can be used.

Different magnetic alloys and materials that have advantageous magnetic properties and are suitable for producing an artificial permanent magnet are already known. Depending on the respective composition, some of these alloys are commercially available and cost effective. For the production of a permanent magnet according to the invention, it is possible to use, for example, as main phase powder or as a component of the main phase powder, an $SE_2$ $(Fe, X)_{14}B$ compound, where SE denotes rare-earth elements, Fe denotes iron, B denotes boron and X denotes any desired chemical element including iron or a number of any desired chemical elements.

By admixing the anisotropic powder having the smaller average particle size and due to the resulting increase in the concentration of components or chemical elements of the anisotropic powder in the edge regions of the particles of the main phase powder, the anisotropy field strength of the permanent magnet is to be increased. For this purpose, it is advantageous that the anisotropic powder contains rare-earth elements which increase the anisotropic field strength, of the main phase powder. It is also possible that the anisotropic powder contains other or additional components and added elements, which also increase the anisotropy field strength of the main phase powder or by means of which the magnetic properties of the artificial permanent magnet can be influenced and adapted to a respective purpose of use.

Depending on the respective constituents and components, the advantages of the method according to the invention occur when, during the heating, the anisotropic powder melts on average slightly more rapidly than the main phase powder or at least the relevant added elements in the anisotropic powder are released sufficiently early, in order to penetrate into the edge regions of the particles of the main phase powder, before the edge regions of the particles of the main phase powder melt off and separate from the particles in question. It has been shown that it is appropriate if the first average particle size of the main powder is over 50% larger than the second average particle size of the anisotropic powder. Preferably, it is provided that the first average particle size is over 100% larger than the second average particle size. The greater the specified difference of the average particle size is, the more rapidly it is possible to achieve, during the sintering process, that the anisotropic powder transitions substantially entirely into a liquid phase and, promoted by grain boundary diffusion, the individual components or added elements from the anisotropic powder encase the particles of the main phase powder and can penetrate into the edge regions of the permanently magnetic particles of the main phase powder.

It has been shown that it is advantageous, both for the production cost of the individual powders and also with a view to the magnetic properties of the artificial permanent magnets, that the first average particle size of the main phase powder is between 3 μm and 10 μm. The second average particle size of the anisotropic powder is accordingly advantageously smaller than 3 μm. However, average particle sizes differing therefrom can also be specified.

During the production of the main phase powder and of the anisotropic powder, it can be ensured by suitable means such as, for example, a controlled grinding process or subsequent sieving or fractionating, that the average particle size of the main phase powder and of the anisotropic powder differ significantly enough. The respective grain size distribution can exhibit differences between the main phase powder and the anisotropic powder, as long as the respective particle size distributions do not differ in such a manner as to prevent thereby an early start of melting of the anisotropic powder and the desired release of the components or added elements of the anisotropic powder, which are to penetrate into the edge regions of the particles of the main phase powder.

Advantageously, it is provided that the proportion of the anisotropic powder in the powder mixture is under 50 percent by weight and preferably under 20 percent by weight. In particular, when, added elements which are expensive in terms of the procurement or the processing or further processing of the powder are used in the anisotropic powder, it is possible to achieve an economic advantage in the production of the artificial permanent magnets by reducing the proportion of the anisotropic powder. Since, due to the different average particle size, a rapid release of the relevant components or added elements in the anisotropic powder is promoted, a considerably lower proportion of the anisotropic powder in relation to the main phase powder is regularly already sufficient in order to bring about a significant increase in the concentration of the relevant components or added elements in the edge region of the particles of the main phase powder and thus a concomitant clear increase in the anisotropic field strength and an improvement of the permanently magnetic properties of the permanent magnet.

The invention further relates to an artificial permanent magnet which has been sintered from a powder mixture. According to the invention, it is provided that the artificial permanent magnet comprises a liquid phase liquefied at least partially during the sintering process and particles of a main phase embedded therein, which comprises a rare-earth transition metal compound with permanently magnetic properties, wherein the particles of the main phase contained in the permanent magnet comprise in an edge region a higher concentration of a substance increasing the anisotropy field strength than in a core region of the particles of the main phase, and wherein this inhomogeneous concentration in the edge regions and in the core regions of the particles of the main phase is independent of their arrangement within the permanent magnet. In particular, both particles of the main phase which adjoin an outer surface of the permanent magnet as well as particles arranged in an internal region at a large distance from an outer surface of the permanent magnet in each case have a similarly inhomogeneous concentration of the substances which increase the anisotropy field strength, wherein the concentration is in each case clearly higher in the edge regions of the particles than in the core regions of the particles.

In contrast to the admixing of substances which increase the anisotropy field strength in the main phase powder, whereby, in most cases, only a substantially homogeneous increase in the concentration of the substances increasing the anisotropy field strength is brought about both in the edge regions and also in the core regions of the particles of the main phase, the artificial permanent magnet according to the invention has an inhomogeneous concentration of the substances which increase the anisotropy field strength or an increased concentration in the edge regions of the particles of the main phase. The remanence of the artificial permanent magnet according to the invention is therefore insignificantly or only slightly influenced and lowered, while the advantageous improvement of the magnetic properties due to the increased anisotropy field strength clearly predominates.

The artificial permanent magnet according to the invention also differs from permanent magnets in which first an artificial permanent magnet is produced by a sintering process, and then, in art additional heating process, a substance which increases the anisotropy field strength is provided externally and penetrates through the outer surfaces of the artificial permanent magnet, since, in this way, an increase in the concentration of the substance increasing the anisotropy field strength in the edge regions of the particles of the main phase powder located there is brought about only in outer surface regions of the permanent magnet due to grain boundary diffusion, but internal regions of the permanent magnet are not reached by the substance penetrating from outside, and no appreciable increase of the anisotropy field strength occurs there. In most cases, by means of such a post-treatment of already produced artificial permanent magnets, only an exponentially abating increase in the concentration of the substance increasing the anisotropy field strength can be achieved in external surface regions of the artificial permanent magnet.

In contrast, in the edge regions of substantially all the outer surfaces and particularly also in an internal region of the artificial permanent magnet at a distance from its outer surfaces, the artificial permanent magnet according to the invention has an advantageous increase in the concentration of the substance which increases the anisotropy field strength. In particular, in the case of large-volume artificial permanent magnets, the opposite outer surfaces of which are spaced by several millimeters and more, it is possible to achieve thereby a stronger influencing and improvement of the permanently magnetic properties, with comparatively low material cost. In addition, there no longer is any need for renewed heating of the permanent magnet, which, in the already known methods, is first produced without an increase in the anisotropy field strength and which then has to be subjected to a post-treatment.

The artificial permanent magnet according to the invention can be produced by the above-described production method according to the invention.

BRIEF DESCRIPTION OF THE DRAWINGS

Below, embodiment examples of the inventive idea, which are represented in the drawings, are explained in further detail. In the drawings.

DETAILED DESCRIPTION

Figure 1:
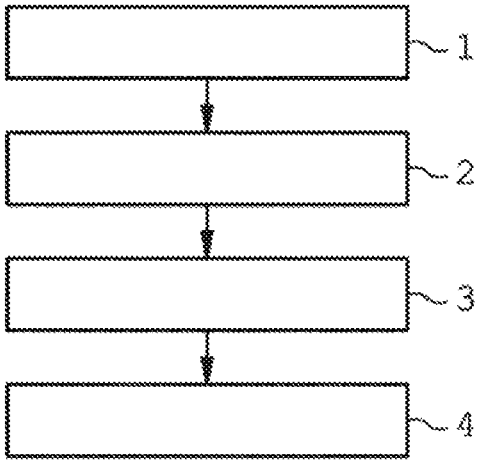
FIG. 1 shows a diagrammatic representation of a sequence of method steps for producing an artificial permanent magnet according to the invention.

In the method sequence represented diagrammatically in FIG. 1, in a powder preparation step 1, a main phase powder and an anisotropic power are prepared. The main phase powder comprises a rare-earth transition metal compound with permanently magnetic properties, for example, an SE $(Fe, X)_1B$ compound. The anisotropic powder comprises particles with components or added elements which bring about a higher anisotropy field strength of the anisotropic powder in comparison to the main phase powder. Both the main phase powder and also the anisotropic powder may in each case be mixtures of at least another two different powders.

The particles of the main phase powder have a first average particle size which is larger than the second average particle size of the particles of the anisotropic powder. The different average particle size can be preset by appropriate crushing or grinding processes, for example. It can also be obtained by sieving or fractionating a selection of particles having an appropriate particle size. In particular, if commercial powder mixtures are used, it is also conceivable that the desired particle size is already provided and can thus be selected accordingly.

In subsequent powder mixing step 2, the main phase powder and the anisotropic powder are mixed together to form a powder mixture.

In a pressing step 3, a pellet is produced from the powder mixture, which is suitable for subsequent heating and sintering and already has the shape of the desired artificial permanent magnet. In the process, it is possible to optionally add additional substances or, for example, a suitable binder to the powder mixture, in order to promote the production of the pellet and the subsequent sintering process. Moreover, components can be added, which, for example, influence and improve the strength or the temperature resistance of the artificial permanent magnet.

In a subsequent heat treatment step 4, the powder mixture with n in powder of the first average particle size and with the anisotropic powder of the second average particle size as well as optionally with other components and added elements is sintered to form an artificial permanent magnet. In the process, the heat treatments which are conventional for a sintering process can be carried out.

Figure 2:
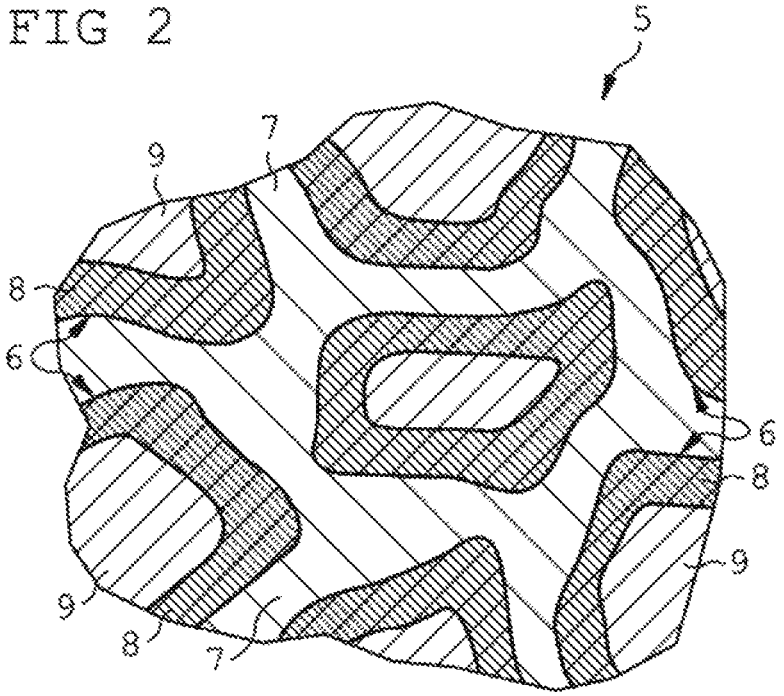
FIG. 2 shows a diagrammatic cross-sectional view through an internal region of an artificial permanent magnet according to the invention.

A cross-sectional view of an artificial permanent magnet 5 produced by the above-described method according to the invention is shown as an example in FIG. 2. The particles 6 of the main phase powder or of the main phase are embedded in a liquid phase 7 which is first liquefied and then crystallized again. The liquid phase 7 was generated during the sintering process from the anisotropic powder, which had melts early and is distributed in its liquid phase around the particles 6 of the main phase powder, surrounding these particles 6. During the heat treatment step 4, added elements penetrated into an edge region 8 of the particles of the main phase powder, and their concentration increased there. Due to the increase in concentration in the edge region 8, the anisotropic field strength of the permanently magnetic particles 6 of the main phase powder is increased, and magnetic interaction, in particular magnetic exchange interaction between adjacent particles of the main phase powder, is reduced. Since the chemical elements in question penetrate only into the edge region 8 of the particles 6 and not into a core region 9 of the particles, there is a concentration increase of only a small proportion of the components or added elements increasing the anisotropy field strength in the particles 6, and the concomitant influencing of the remanence of the particle 6 is kept low.

With the embodiment example described below, it was possible to demonstrate a clear improvement of the magnetic properties in an artificial permanent magnet produced according to the invention. First, a main phase powder was produced from a ternary Nd—Fe—B alloy, where Nd denotes neodymium, Fe denotes iron and B denotes boron. The main phase powder was finely ground to an average grain size of approximately 6 μm. An anisotropic powder was produced from a second alloy consisting substantially of SE-TM-B, where SE denotes a rare-earth element and B denotes boron, and the component denoted TM also contained, in addition to iron, other chemical elements such as gallium, copper and aluminum, for example. The anisotropic powder was finely ground to an average grain size of approximately 3 μm. In both cases, before the grinding process, the starting materials were homogenized, hydrated and dehydrated according to the usual methods.

From the main phase powder having the first average particle size of approximately 6 μm and the anisotropic powder having a second average particle size of approximately 3 μm, a powder mixture was prepared, consisting of approximately 90 percent by weight of the main phase powder and approximately 10 percent by weight of the anisotropic powder. Subsequently, a pellet was formed and an artificial permanent magnet was sintered.

As reference object, another artificial permanent magnet was produced, in which the same materials of the main phase powder and of the anisotropic powder were prepared in each case with similar quantity proportions, but with a consistently lower particle size of 6 μm, and therefrom a reference permanent magnet was sintered.

By measuring the respective demagnetization curves, it was possible to determine that both the artificial permanent magnet produced according to the invention and the reference permanent magnet exhibited an identical remanence, within the limits of measurement precision, both at room temperature and also at approximately 100° C. In contrast, at room temperature, the intrinsic coercive field strength of the permanent magnet according to the invention was approximately 10% higher than the intrinsic coercive field strength of the reference permanent magnet. Even in the case of heating to approximately 100° C., the intrinsic coercive field strength of the permanent magnet according to the invention was still clearly higher than the intrinsic coercive field strength of the reference permanent magnet.

The invention claimed is:

1. A method for producing an artificial permanent magnet, comprising, preparing a main phase powder, the main phase powder comprising a rare-earth transition metal compound with permanently magnetic properties and with a first average particle size, and an anisotropic powder, the anisotropic powder having a higher anisotropy field strength than the main phase powder and having a second average particle size which is smaller than the first average particle size, wherein mixing the main phase powder and the anisotropic powder together to form a powder mixture, generating a molded body using powder metallurgical methods subsequent to the mixing step, sintering the powder mixture with the main phase powder of the first average particle size and with the anisotropic powder of the second average particle size to form an artificial permanent magnet subsequent to the mixing step, wherein both the main phase powder and also the anisotropic powder are in each case mixtures of at least another two different powders, and wherein the main phase powder contains an $SE_2$ (Fe, $X)_{14}$ B compound, where SE denotes rare earth elements, Fe denotes iron, B denotes boron and X denotes any desired chemical element including iron or a number of any desired chemical elements.

2. The method according to claim 1, wherein the main phase powder contains at least one rare-earth element.

3. The method according to claim 1, wherein the anisotropic powder contains at least one rare-earth element.

4. The method according to claim 1, wherein the anisotropic powder contains at least one $SE_2$ (Fe, $X)_{14}$ B compound, where SE denotes rare earth elements, Fe denotes iron, B denotes boron and X denotes any desired chemical element including iron or a number of any desired chemical elements.

5. The method according to claim 1, wherein the first average particle size of the main phase powder is over 50% larger than the second average particle size of the anisotropic powder.

6. The method according to claim 1, wherein the first average particle size is between 3 μm and 10 μm.

7. The method according to claim 1, wherein the second average particle size is smaller than 3 μm.

8. The method according to claim 1, wherein the proportion of the anisotropic powder in the powder mixture is less than 50 percent by weight.

* * * * *